US007051818B2

(12) United States Patent
Crawford et al.

(10) Patent No.: US 7,051,818 B2
(45) **Date of Patent: *May 30, 2006**

(54) THREE IN ONE COMBINED POWER UNIT FOR NITROGEN SYSTEM, FLUID SYSTEM, AND COILED TUBING SYSTEM

(75) Inventors: James B. Crawford, Lafayette, LA (US); Edward R. Lamb, Lafayette, LA (US)

(73) Assignee: P.E.T. International, Inc., Las Vegas, NV (US)

( * ) Notice: Subject to any disclaimer, the term of this patent is extended or adjusted under 35 U.S.C. 154(b) by 192 days.

This patent is subject to a terminal disclaimer.

(21) Appl. No.: 10/691,309

(22) Filed: Oct. 22, 2003

(65) Prior Publication Data

US 2004/0244993 A1 Dec. 9, 2004

Related U.S. Application Data

(63) Continuation-in-part of application No. 10/127,092, filed on Apr. 22, 2002, now Pat. No. 6,702,011.

(51) Int. Cl.
*E21B 19/22* (2006.01)

(52) U.S. Cl. ..... 166/379; 166/77.2; 166/90.1

(58) Field of Classification Search ..... 166/379, 166/77.2, 77.3, 85.1, 90.1

See application file for complete search history.

(56) References Cited

U.S. PATENT DOCUMENTS

| | | | | |
|---|---|---|---|---|
| 4,585,061 | A * | 4/1986 | Lyons et al. | 166/77.3 |
| 5,291,956 | A | 3/1994 | Mueller | |
| 5,566,764 | A | 10/1996 | Elliston | |
| 5,842,530 | A | 12/1998 | Smith | |
| 6,003,598 | A | 12/1999 | Andreychuk | |
| 6,230,805 | B1 * | 5/2001 | Vercaemer et al. | 166/300 |
| 6,264,128 | B1 * | 7/2001 | Shampine et al. | 242/397.3 |
| 6,273,188 | B1 * | 8/2001 | McCafferty et al. | 166/77.2 |
| 6,408,955 | B1 | 6/2002 | Gibson | |
| 6,609,565 | B1 | 8/2003 | Andreychuk | |
| 6,702,011 | B1 | 3/2004 | Crawford | |
| 6,830,101 | B1 | 12/2004 | Saheta | |
| 6,868,902 | B1 | 3/2005 | Roodenburg | |

* cited by examiner

*Primary Examiner*—William Neuder
(74) *Attorney, Agent, or Firm*—Arthur M. Dula

(57) ABSTRACT

A single tractor unit is provided for pulling a trailer, in which the tractor itself drives a plurality of hydraulic motors which control a crane unit, a coiled tubing injection unit, and the pumps and motors associated with a liquid nitrogen system which is used for injecting gaseous hydrogen into a work-over well with coiled tubing. In an alternative mode, the liquid nitrogen system is replaced with nitrogen generators or tanks of compressed nitrogen gas. In another alternative embodiment, a separate engine, preferably mounted with the other equipment on a trailer, skid, or barge, replaces the single tractor engine for driving the plurality of hydraulic motors. In yet another embodiment, a single engine drives a plurality of well treating systems on an off-shore installation.

29 Claims, 12 Drawing Sheets

THREE IN ONE COMBINED POWER UNIT FOR NITROGEN SYSTEM, FLUID SYSTEM, AND COILED TUBING SYSTEM

RELATED APPLICATION

This application is a second Continuation-in-Part of U.S. patent application Ser. No. 10/127,092, filed Apr. 22, 2002 now U.S. Pat. No. 6,702,011, for "Combined Nitrogen Treatment System and Coiled Tubing System In One Tractor/Trailer Apparatus".

FIELD

This invention relates, generally, to the treatment of oil and gas wells using nitrogen to increase the production capability of the wells, and specifically, to providing on a single trailer/skid combination, all of the equipment accessories to pump nitrogen through a coiled tubing into the wells being treated and a single prime mover power source for operating such equipment.

BACKGROUND OF THE INVENTION

It is known in the art to provide work over operations using gaseous nitrogen to remove sand and/or water or other impediments to production. The prior art has not recognized that a single trailer or skid unit, with a single prime power source, can be provided with all of the equipment and accessories for running a nitrogen and fluid pumping service in combination with a coiled tubing unit to treat such wells. The prior art typically brings two tractor trailer assemblies to the well to be treated, one having a coiled tubing unit, and one having the nitrogen unit. Because of the duplicity of the tractor trailer units, this has caused a doubling of the transportation costs, a doubling of the personnel required to have the units arrive at the well, and a doubling of the number of personnel required to run this service. Further, for offshore applications, the prior art typically requires separate power sources, each dedicated to each of the primary functions, coiled tubing, nitrogen evaporation/injection and fluid pumping.

It is an object of this present invention to provide a combined tractor trailer unit which utilizes a single tractor and a single trailer to provide a service for treating wells with a combined tractor trailer unit through which gaseous nitrogen can be pumped.

It is a further object of this present invention to provide a single trailer, skid, or barge to provide a service for treating wells.

DETAILED DESCRIPTION OF EMBODIMENTS OF THE INVENTION

Figure 1:
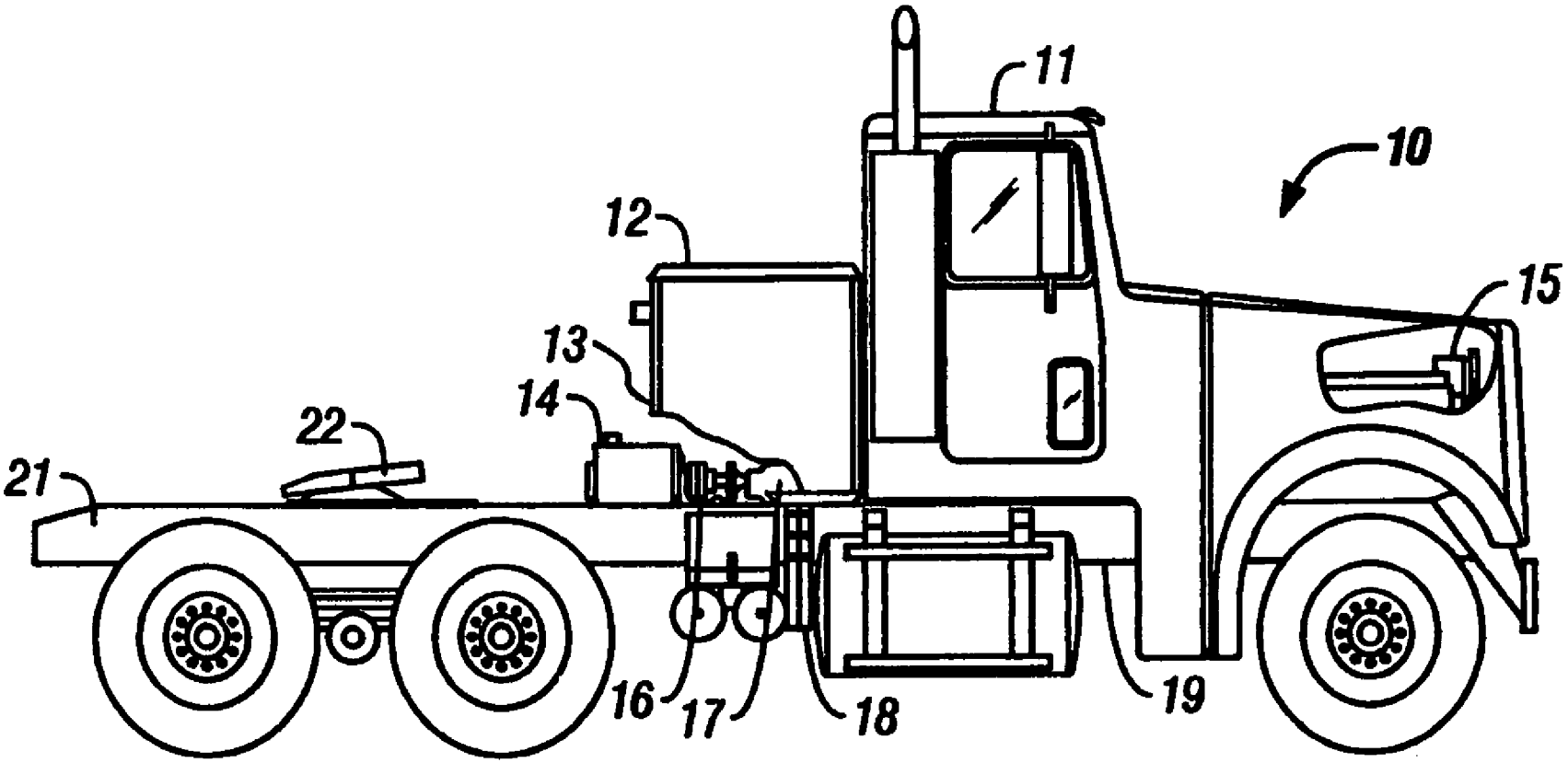
FIG. 1 is an elevated, schematic view of a tractor unit which can be used in accordance with the present invention.
Figure 2:
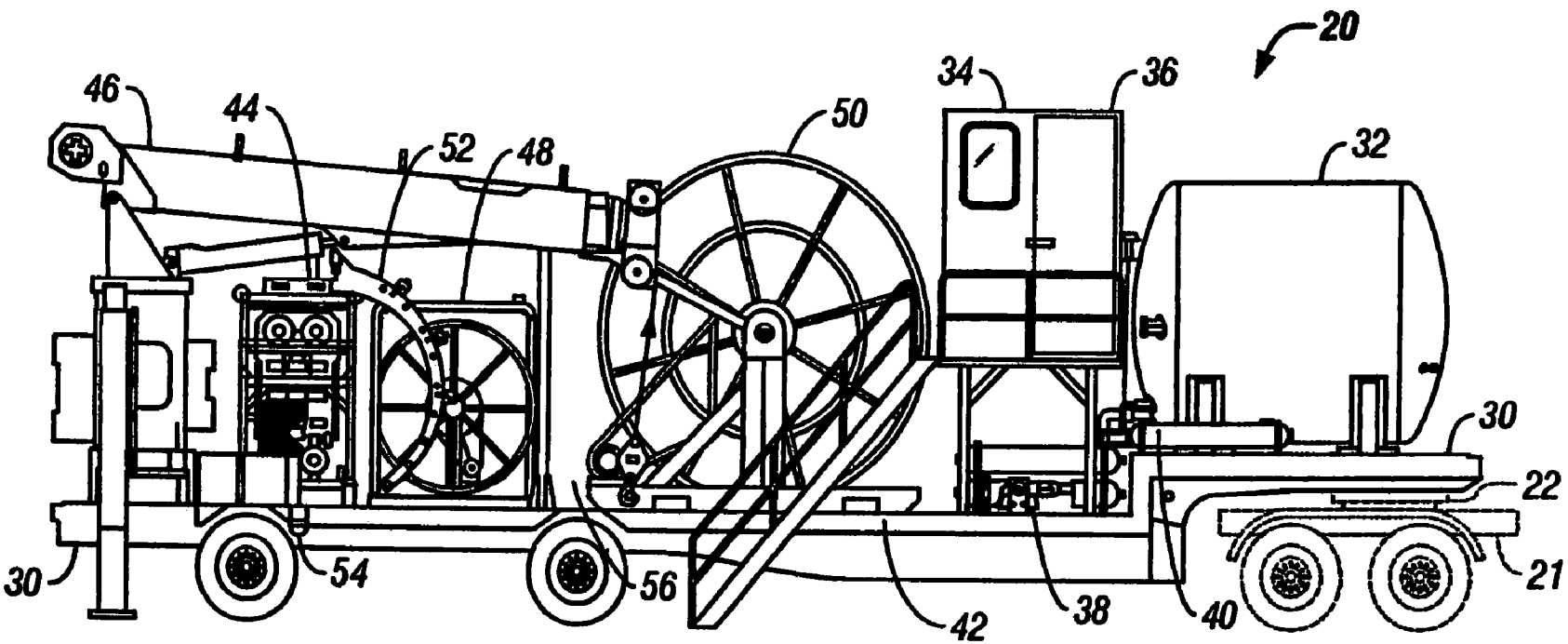
FIG. 2 is an elevated, pictorial view of a trailer unit which can be used in accordance with the present invention with the tractor illustrated in FIG. 1.

Referring now to FIG. 1, a tractor 10 having either a gasoline engine or a diesel engine is illustrated and which is used to pull the trailer 20 illustrated in FIG. 2 and which also uses its engine to drive all of the components which are illustrated in FIG. 1. and FIG. 2, on the tractor 10, and the trailer 20, respectively. The chassis 11 of the tractor 10 may be, for example, a Freightliner. The tractor 10 also has a hydraulic tank 12 and a tank holddown unit 13 which secures the hydraulic tank to the chassis. A hydraulic pump 14 has a coupling and a drive mechanism connected to its one end. The coupling 16 is connected into a transfer case and drive shaft mechanism 17. A hydraulic pump 18 is one of many hydraulic pumps in the tractor assembly 10 and also includes various hydraulic pumps within the assembly 19. It should be appreciated that all of the mechanisms illustrated with the tractor 20 in FIG. 2 are driven by hydraulic pumps located on the tractor chassis 10. The assembly 15 is a hydraulic pump which includes a clutch pulley being driven by the engine located within the tractor 10. The tractor bed 21 has an assembly 22 which is used to connect the tractor to the trailer as illustrated in FIG. 2.

Referring now to FIG. 2 in more detail, mounted on the trailer bed 30 which is connected to the tractor bed 21 by way of the mechanism 22, is a cryogenic nitrogen tank 32. As is well known in this art, liquid nitrogen has a greatly reduced volume compared to the volume of gaseous nitrogen. Nitrogen, when frozen to −320° F., is a liquid and accordingly, it is much preferred to transport the liquid nitrogen to the well site to provide additional volume of nitrogen gas which is to be pumped into the well. Also mounted on the tractor bed 30 is a control cabin 34 in which the electrical and hydraulic units 36 are controlled by a human operator. The nitrogen system 38 which is described in more detail hereinafter is also located on the tractor bed as is a heat exchanger 40 which is used to heat up the pumped liquid nitrogen to a temperature which causes the liquid to become gaseous, which can then be pumped into the well. The piping system 42 enables the gaseous nitrogen to be pumped into one end of the coiled tubing to allow the gaseous nitrogen to be pumped out of the other end of the coiled tubing.

An injector unit 44, also described in more detail hereinafter, is situated on the tractor bed floor. A hydraulically driven crane 46 is also situated on the tractor bed floor for situating the coiled tubing injector 44 immediately above the well being treated. A hose reel 48 and a coiled tubing reel 50 are also situated on the tractor floor. A goose neck 52 is also situated on the tractor floor adjacent the coiled tubing injector system 44 for feeding the coiled tubing from the reel into the injector. A stripper 54 is located on the lower end of the coiled tubing injector system 44 for enabling the coiled tubing to be placed into the well being treated. A BOP unit 56 is also located on the tractor floor to be used in shutting in the well to be treated, if needed.

Figure 3:
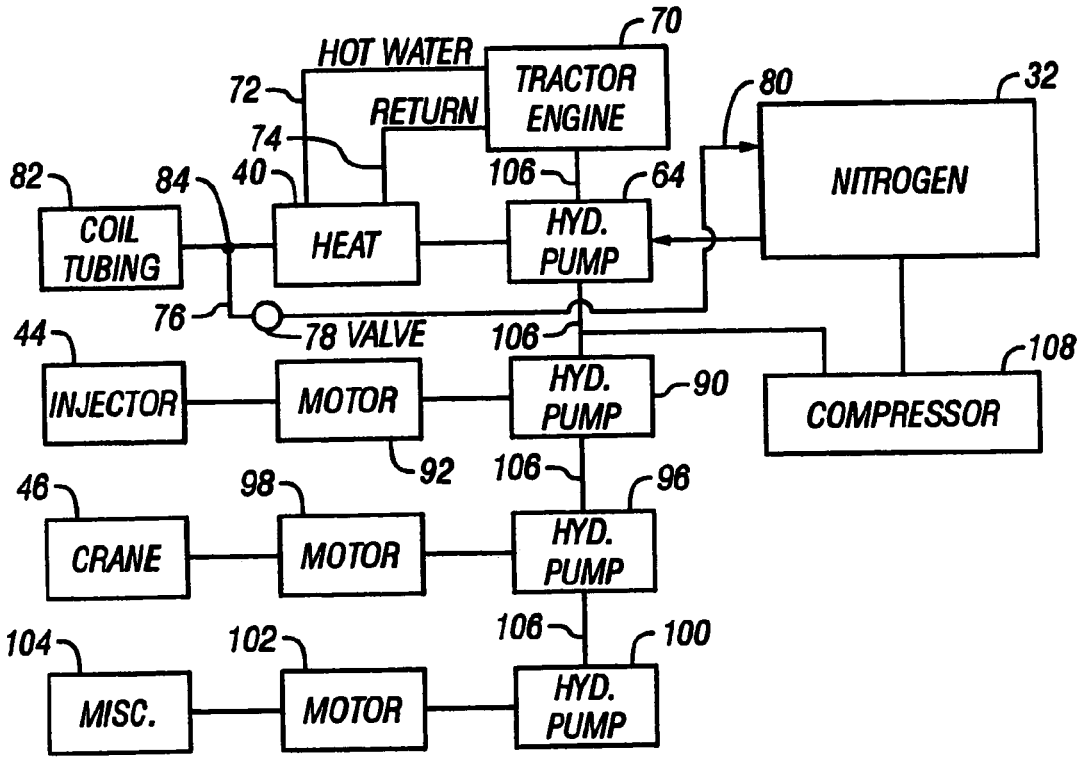
FIG. 3 illustrates, in block diagram, the various systems which are used in accordance with one embodiment of the present invention to treat a well with nitrogen.

Referring now to FIG. 3, there is illustrated in block diagram some of the components which are illustrated in FIGS. 1 and 2. The liquid nitrogen tank 32 has its output connected into the input of a hydraulic pump 64 whose output is connected into the input of the heat exchanger 40 illustrated in FIG. 2. The tractor engine 70, which may be either gasoline powered or diesel powered has a hot water line 72 connected to its radiator and which provides hot water to the heat exchanger 40. A return line 74 from the heat exchanger returns the water from the heat exchanger back into the radiator of the tractor engine 70. The pump 64 is designed to pump the liquid nitrogen having a temperature near −320° F. into the input of the heat exchanger 40. Such pumps are commonly available in the industry for pumping liquid nitrogen. As the liquid nitrogen is pumped through the heat exchanger 40, the heat exchanger will cause the liquid nitrogen to rise above a gasification point which is near 0° F. that the output from the heat exchanger is gaseous nitrogen. A gas line 76 can then return a portion of the gaseous nitrogen through the valve 78 back into the return line 80 which enables some of the gaseous nitrogen to be returned into the top of the nitrogen tank 32, if and when desired. The output of the heat exchanger 40 is also coupled into one end of the coiled tubing illustrated in the box 82 through as many valves as are necessary for turning the nitrogen on or off to the coiled tubing 82. One such control valve is illustrated as valve 84. The valve 84 would preferably be a three-way valve which can either cut the gaseous nitrogen off so that it would not flow either into the coiled tubing or the valve 78 or would flow into only one or the other of the coiled tubing 82 and the valve 78.

A hydraulic pump 90 is connected into a hydraulic motor 92 which is used to drive the chains of the injector 44 which can either move the coiled tubing into the well being treated or pull the coiled tubing out of the well being treated, as desired, depending on the direction of the chain rotation.

Another hydraulic pump 96 drives a motor 98 to drive the crane 46 illustrated in FIG. 2. Another hydraulic pump 100 drives a motor 102 which in turn drives any one or more miscellaneous items requiring a hydraulic activation as desired.

It should be appreciated that the tractor engine 70 drives each of the hydraulic pumps 64, 90, 96 and 100 as shown by the line 106. Coming off of the tractor engine 70, the hydraulic pump 64, 90, 96 and 100 are preferably driven by one or more belts which can be used with clutch pulleys as desired. A compressor unit 108 which is also driven by the tractor engine 70 is run off of the drive line 106 to assist in keeping the liquid nitrogen down to its desired temperature.

It should be appreciated that while the tractor engine 70 is obviously and desirably located on the tractor, and the coiled tubing, the injector, and the crane, as well as the liquid nitrogen tank 32 are preferably located on the tractor, most of the other items identified in FIG. 3 can be found on either the tractor and/or the trailer as desired. The important feature of this invention is to recognize that all of the items shown in FIG. 3 are located on a combined tractor/trailer configuration which does not require the use of either another tractor or another trailer.

Figure 4:
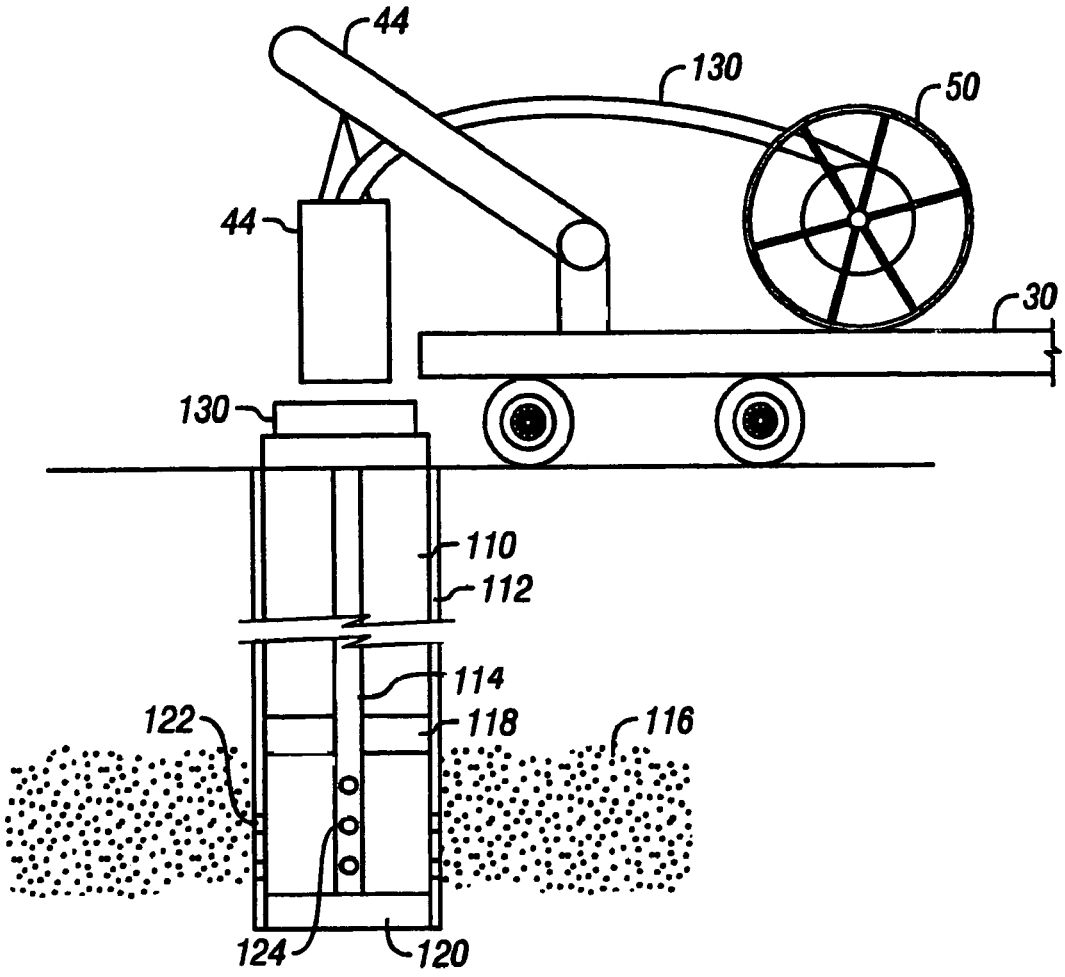
FIG. 4 is an elevated, diagrammatic view of an oil or gas well which is being treated with nitrogen from the coiled tubing unit in accordance with the present invention.

Referring now to FIG. 4, there is a simplified schematic illustrating the process contemplated by this invention for treating a producing oil or gas well which has, for whatever the reason, either quit producing or has started producing with a reduced volume of oil or gas. The tractor trailer illustrated in FIGS. 1 and 2 is delivered to the site of the well 110 which typically is cased with steel casing 112 and which has a string of production tubing 114 running down to the pay zone 116 in the surrounding formation and which has a pair of packers 118 and 120 which straddle the pay zone. With such wells, the casing 112 has a plurality of perforations 122 which enable the oil or the gas to leave the pay zone and come into the interior of the well. The production tubing 114 has a screen or other holes in it 124 which allow the oil or gas to leave the pay zone 116, come through the perforations 122 and enter the production tubing 114 which then allows the oil or gas to travel to the earth's surface.

There are various things which can cause the well in question to quit producing at a rate which it has been experiencing before. There can be sand which enters through the perforations and the holes in the production tubing which plug it up substantially and reduce the amount of oil or gas being produced. Another problem which exists in addition to the sanding problem is the existence of water which may be sitting on top of the oil or gas being produced. Since many of the pay zones contain water, and because of the weight of the water sitting on top of the oil or gas being produced, the oil or gas simply will not proceed up to the surface. To overcome either one of these problems, it is desirable to pump gaseous nitrogen down through the production tubing 114 to push the sand and/or the water out of the production tubing string 114 and back up through the annulus between the steel casing and the production tubing. This can be accomplished either by not using the production packer 118 or by having bypass valves which pass through the production packer 118 and allow the sand and/or the water to be produced up the annulus through the earth's surface and once again, place the production of the pay zone back to what it was before the problem occurred. In an alternative mode, the packer 118 can remain in the cased borehole as illustrated, unbypassed, and the gaseous nitrogen when bubbled out of the end of the coiled tubing beneath the perforations, will drive sand and/or the water back to the earth's surface through the production tubing itself.

To accomplish all of this, it is desirable that the gaseous nitrogen be introduced from the earth's surface by passing the gaseous nitrogen through the coiled tubing from the coiled tubing reel located on the bed of the tractor. To get the coiled tubing 130 into the interior of the production tubing string 114, the coiled tubing injector 44 is moved by the crane unit 46 to be immediately above the Christmas Tree 130 which is, of course, the well-known oilfield apparatus which is placed at the top of the producing well 110. The coiled tubing 130 is run through a well-known stripper into the interior of the Christmas Tree 130 and enters the interior of the production tubing string 114 without causing any leaks of any substance within the well to be vented into the atmosphere. The gaseous nitrogen is then caused to exit the lower end of the coiled tubing 130, usually as the coiled tubing is being pushed into the production tubing, or can be turned on after the coiled tubing is in place in the well, if desired. The gaseous nitrogen then causes any water and/or sand which is plugging up the system to be routed through the annulus between the production tubing and the casing to cause the sand and/or the water to be removed from the system, which allows the well to again become productive. While the injector system 44 is shown in block diagram, such injector systems are well-known in the art as described and illustrated in U.S. Pat. No. 5,566,764, the disclosure of which is incorporated herein by reference. Such systems normally involve the use of one or two rotating chains which can be caused to rotate in one direction to grab a hold of the coiled tubing and inject it into the tubing within the well, or by reversing the direction of the motor, the tubing can be pulled out of the well. As illustrated in FIG. 3, the hydraulic pump 90 drives the motor 92 which causes the one or more chains to rotate within the injector 44, for example, as illustrated with respect to the aforementioned U.S. Pat. No. 5,566,764.

Figure 5:
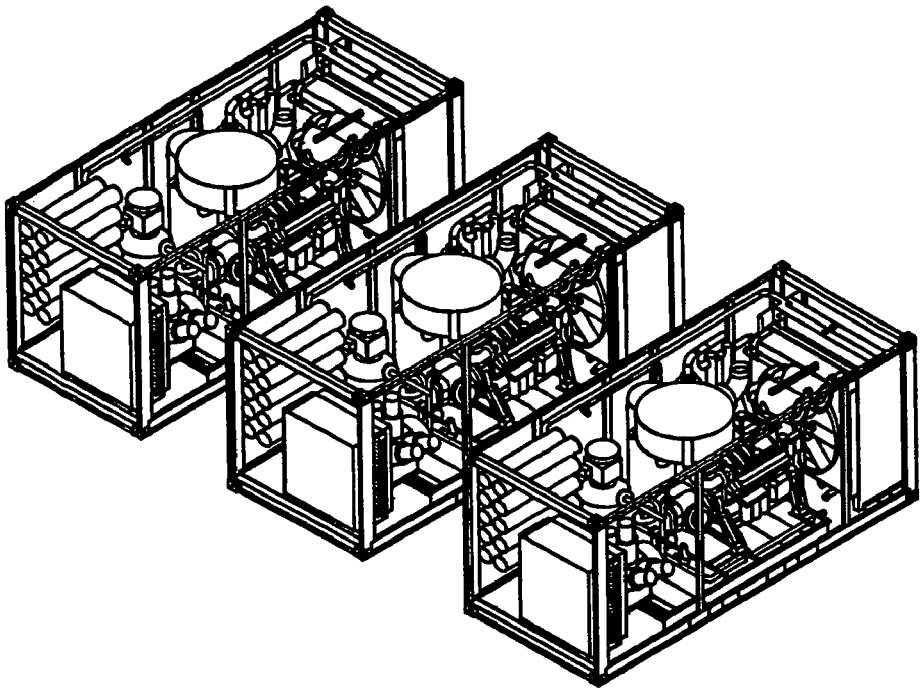
FIG. 5 is a pictorial view of three nitrogen generators which can be used as a substitute for the liquid nitrogen tank.
Figure 6:
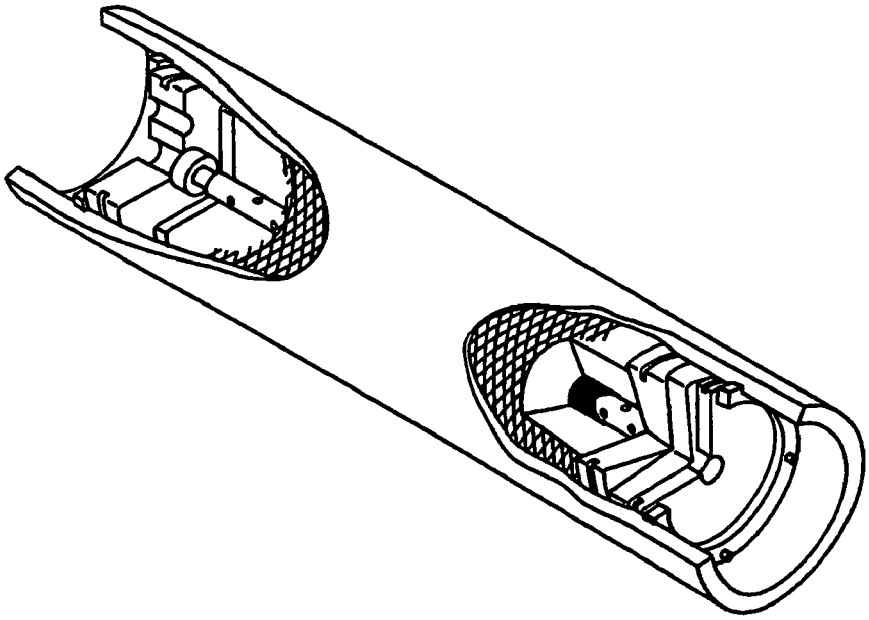
FIG. 6 is a pictorial view of a unit using membrane technology to pull gaseous nitrogen out of the atmosphere.

It should be appreciated that although the present invention contemplates using the liquid nitrogen tank 32 illustrated on the trailer 20 to generate gaseous nitrogen, the invention also contemplates that instead of using the tank 32 illustrated in FIG. 2 as a source of liquid nitrogen, there are additional sources which can be utilized. For example, nitrogen generators can be used, shown in FIG. 5, which extract nitrogen from the atmosphere which can eliminate the costs of transporting and filling nitrogen tanks. Some of such nitrogen generators utilize a membrane, shown in FIG. 6, which allows nitrogen-rich air from the earth's atmosphere to be continuously fed into bundle housing. The air reaches the center of the bundle of membrane fibers which at that point, consists mostly of gaseous nitrogen. The nitrogen collects in the mandrel at the center of the bundle. As the air passes through the bundle of membrane fibers, the oxygen and other fast gases pass through the wall of the membrane fibers as they go through the fibers to be collected at the end. Oxygen and the other fast gases are continuously collected and are moved from the bundle, thus leaving the nitrogen available to be used for injection into the well being treated. By stacking a plurality of such nitrogen generators, available volumes are provided which have an increased flow capability.

Figure 7:
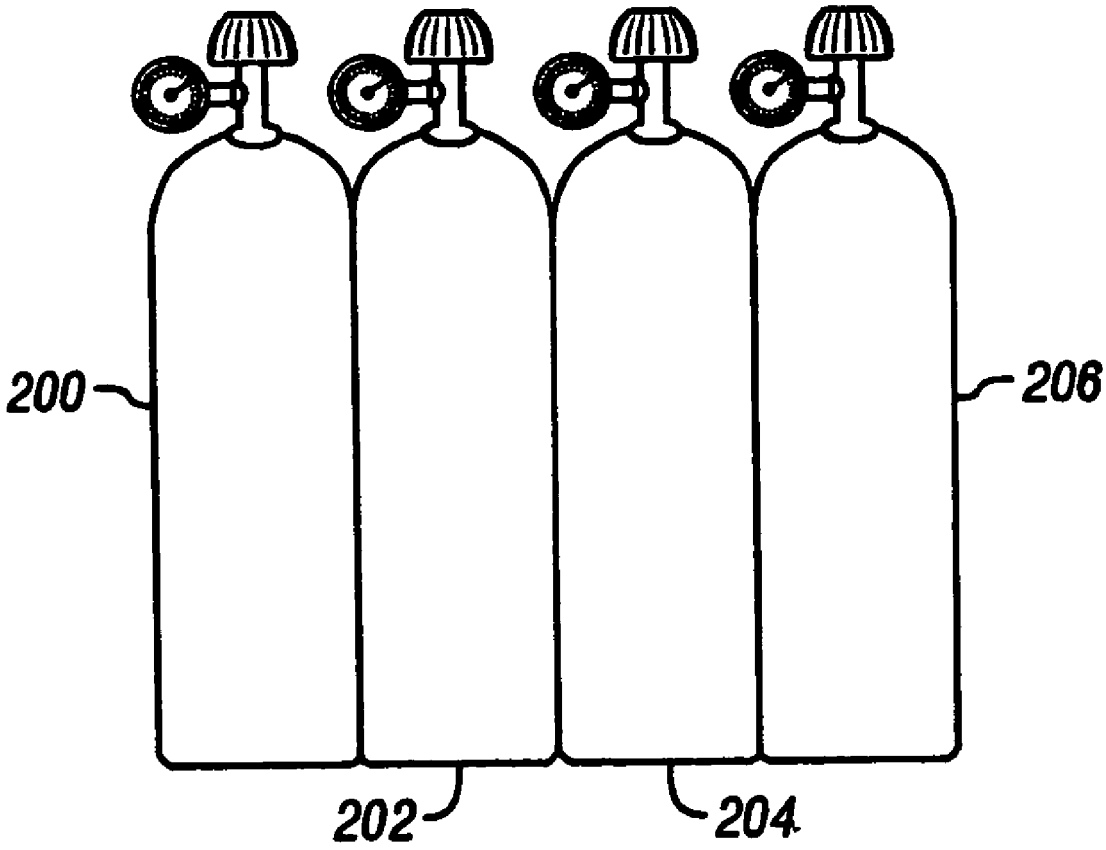
FIG. 7 is an elevated pictorial view of a plurality of tanks used for storing compressed nitrogen gas.

In an alternative mode, albeit not as preferred as either the liquid nitrogen or the nitrogen generator modes, the gaseous nitrogen source can be one or more tanks of compressed nitrogen gas such as the tanks 200, 202, 204 and 206 illustrated in FIG. 7.

Figure 8:
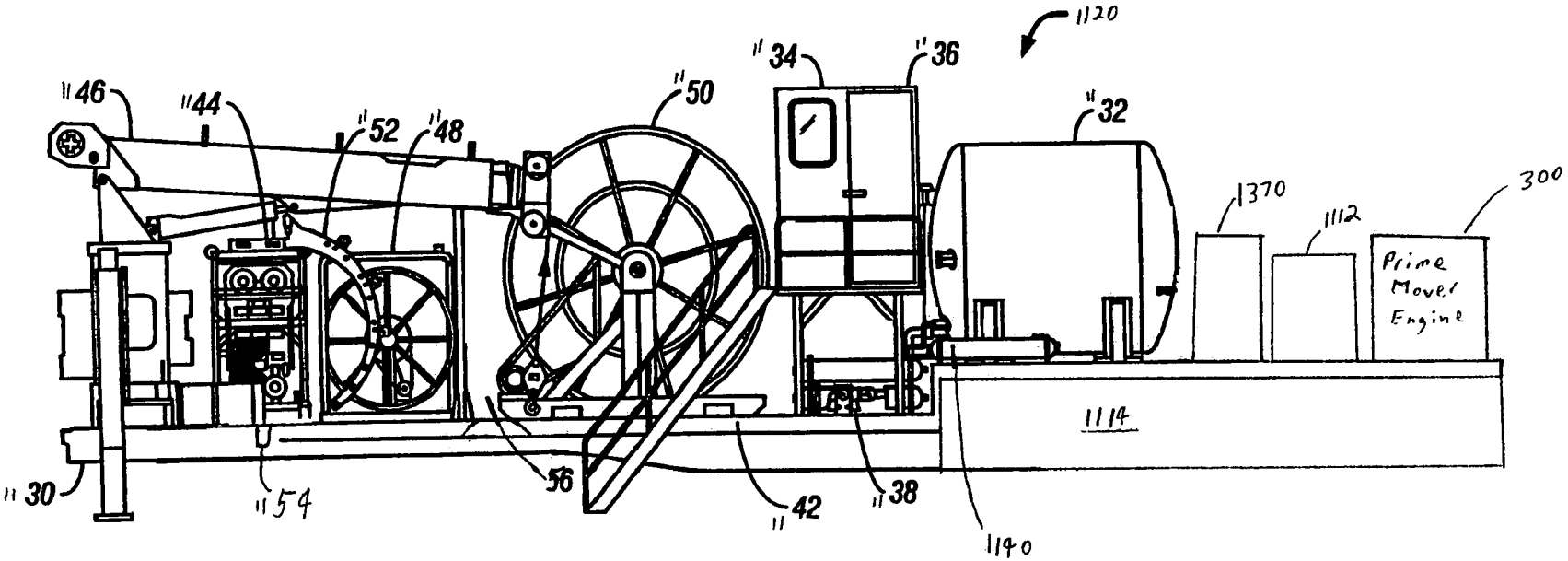
FIG. 8 is an elevated, pictorial view of a trailer/skid unit which can be used in accordance with the present invention.

In another embodiment, rather than employing a single tractor engine as the prime power unit, a separate power unit can be employed to drive the entire system. In this embodiment, a single power unit 300 is preferably mounted along with the equipment it is to power on a single trailer or skid (see FIG. 8). FIG. 8 illustrates substantially similar equipment to that illustrated in FIGS. 1 and 2 and more fully discussed herein above. However, now the equipment is combined on a single trailer, a skid, or a barge 1120. It should be appreciated that the equipment can be combined on any type of vehicle and should not be specifically limited to a trailer, a skid, or a barge. Additionally, the power unit 300, which is preferably a diesel or gasoline engine, is also mounted on the single trailer/skid 1120. Additionally, the trailer/skid 1120 also comprises the hydraulic pumps and drive mechanisms, generally designated 1114, which were previously described as being part of the tractor 10. Still further the trailer/skid 1120 would preferably include at least one hydraulic fluid tank 1112. Although not specifically illustrated, it must be understood that the trailer/skid 1120 would also include necessary conventional hydraulic connections, such as hoses or pipes, to facilitate hydraulic power between the hydraulic fluid tank 1112, the hydraulic pump system 1114, and the equipment being driven by the hydraulic power. It should be appreciated that elements designated in FIGS. 1 and 2 correspond to elements designated in FIG. 8 with the digit 11 placed before the corresponding element numbers. It should further be appreciated, by those in the art, that this embodiment allows for the single trailer/skid 1120 to be dropped of at a job site and the tractor is not required to remain with the trailer or skid; thus, freeing up valuable manpower and equipment.

This system would also preferably comprise a conventional fluid pumping system 1370. Although not specifically illustrated in FIG. 8, the fluid pumping system 1370, includes, but is not limited to, at least one high pressure fluid pump and at least on fluid charge pump as well as associated fittings, connections, piping, hoses, and the like. It should be appreciated that fluid pumping refers to any of a variety of non-nitrogen fluids that may be introduced into a wellbore for intervention work. These fluids are preferably liquids, but may also be in slurry form. These fluids include, but are not limited to, water, foaming agents, surfactants, paraffin solvents or inhibitors, jelling agents, acids and other fluids employed in well treating.

Figure 13:
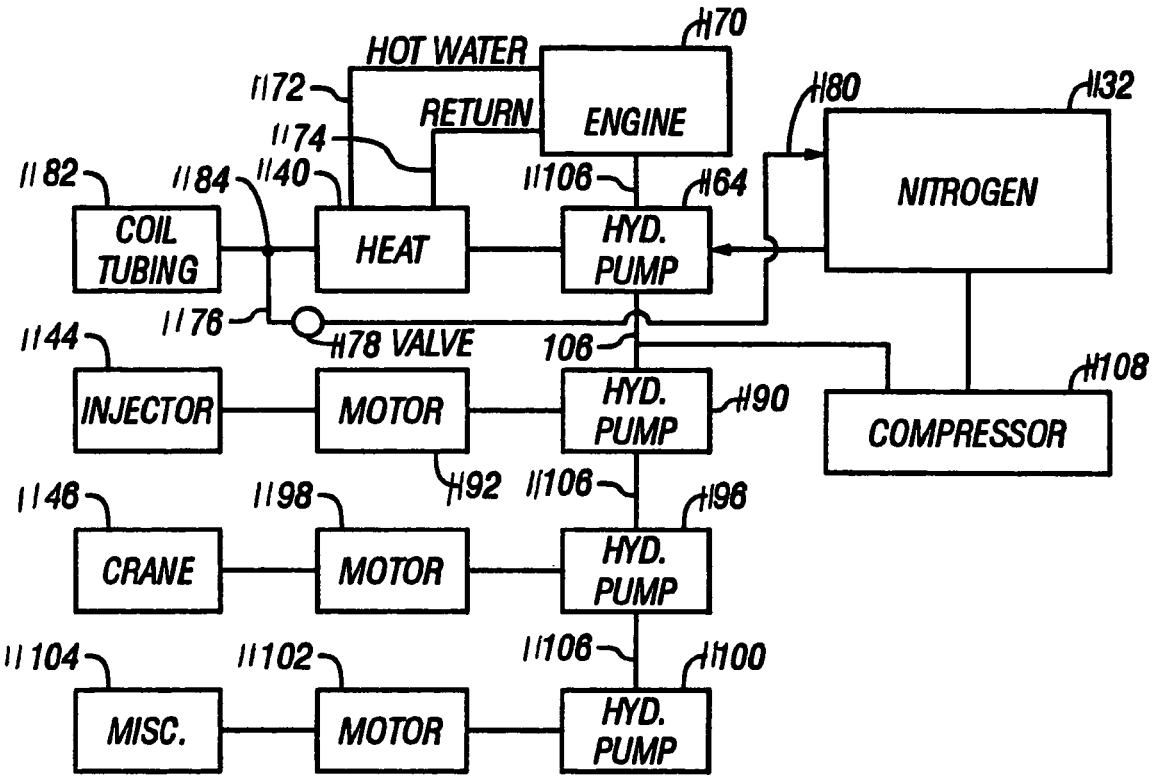
FIG. 13 illustrates, in block diagram, the various systems which are used in accordance with an embodiment of the present invention, combined on a single trailer, skid, or barge to treat a well with nitrogen.

FIG. 13 illustrates a block diagram similar to FIG. 3. Again, it should be noted that the the elements of FIG. 13 are designated with the same numbers as in FIG. 3 with a prefix of "11". The illustration, in FIG. 13, serves as a clarification that the combination of equipment heretofor shown in FIGS. 1 and 2 can all be combined on a single trailer, skid, or barge 1120 with the addition of a single prime mover engine 300.

In yet another embodiment, preferably used for offshore applications, the system described herein above, can be modularized in a series of separate skids. It should be appreciated that the space constraints, of an offshore drilling or production unit, may prohibit the placing of a single trailer/skid containing all of the above described equipment. Further, some of the equipment required for well treatment, such as a crane or nitrogen storage tanks, whether liquid nitrogen, nitrogen generators and/or membrane filters (see FIGS. 5 and 6), or separate air tanks (see FIG. 7), may already be present on the offshore unit. It should be understood that a crane that is already present on the offshore unit may have another engine available to provide power. It should further be understood that the crane, the coiled tubing, the coiled tubing injection unit, and the nitrogen can all be brought to the site or the offshore unit on separate skids or combined on one or more skids. However, the primary power would still be supplied by the single engine (except for the crane if it was supplied separately and with a separate power source). Therefore, a modularized package would be necessary. However, an alternate embodiment, for offshore applications, preferably consists of a barge onto which all the necessary equipment has been located and is further described herein below.

Figure 9:
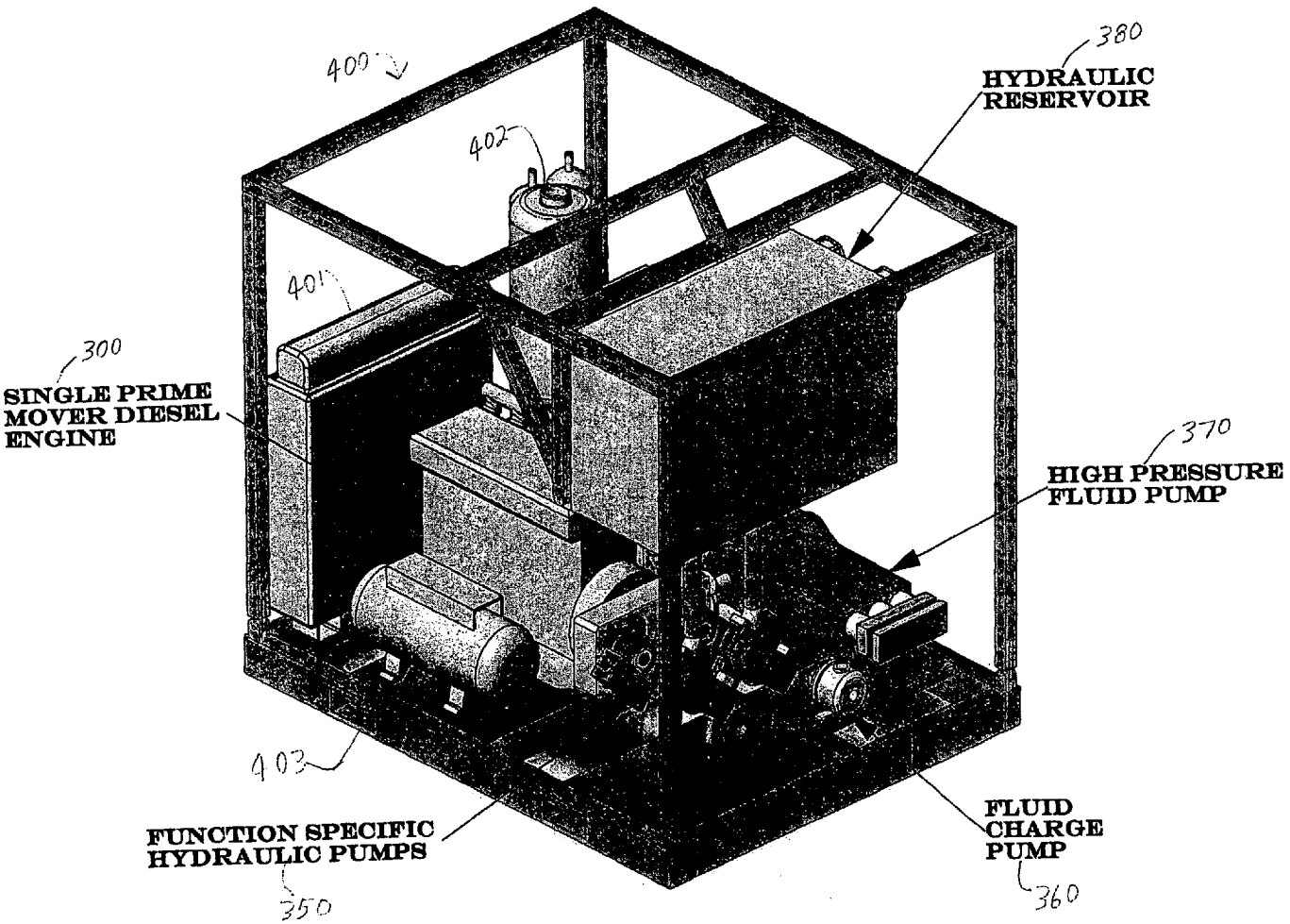
FIG. 9 is a pictorial view of the prime power skid.

The modularized concept would preferably consist of a power unit skid 400 (see FIG. 9). It should be appreciated that the uniqueness of this embodiment, as well as for the single trailer/skid 1120 embodiment, lies in the understanding of how the power demands on a typical well intervention fluctuate. Working within specific capacity parameters and employing innovative means of load sharing and power management, the operation of a coiled tubing unit, nitrogen system and fluid pump are all possible from a single prime mover power source. When fluid pump demands for power are at there highest, nitrogen demands are at zero. Similarly when nitrogen rates are at maximum, fluid pump needs are zero. By insuring that the mid point of each of these demands is met, and enough additional power is available to maintain coiled tubing unit functions, this embodiment has substantially reduced the amount of physical equipment required to perform many coiled tubing deployed well intervention procedures.

Figure 10:
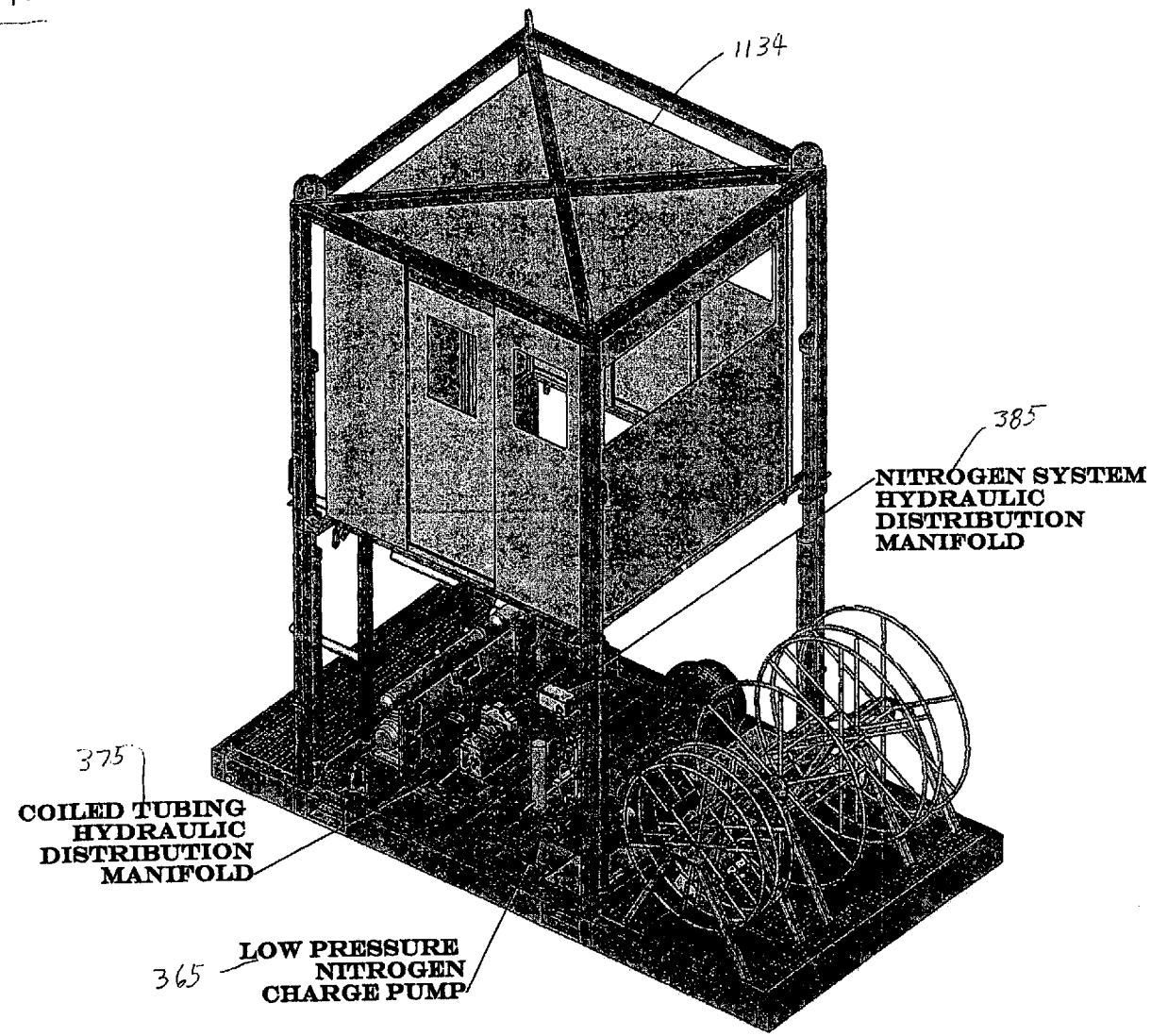
FIG. 10 is a pictorial view of the console and nitrogen system.
Figure 11:
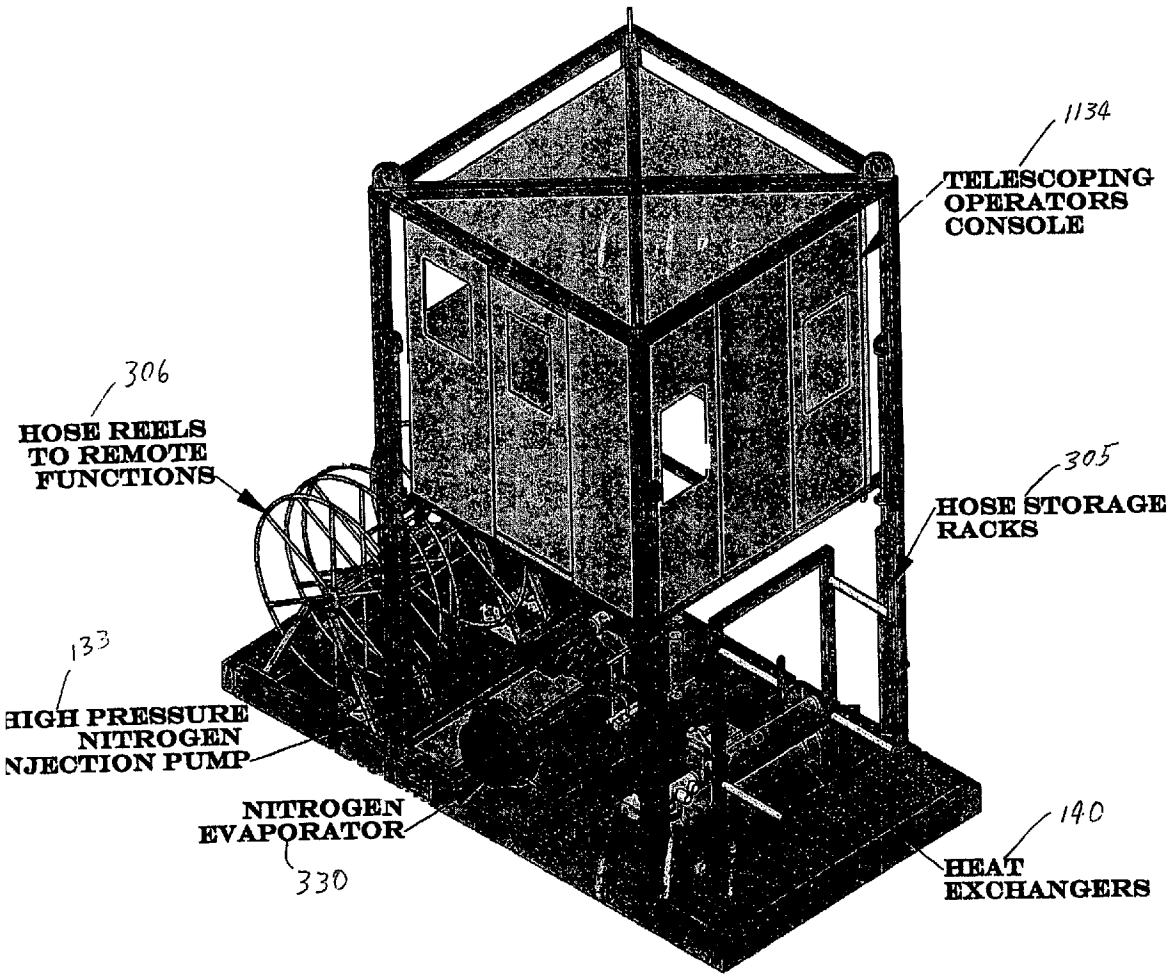
FIG. 11 is a view of the other side of the console and nitrogen system shown in FIG. 10.
Figure 12:
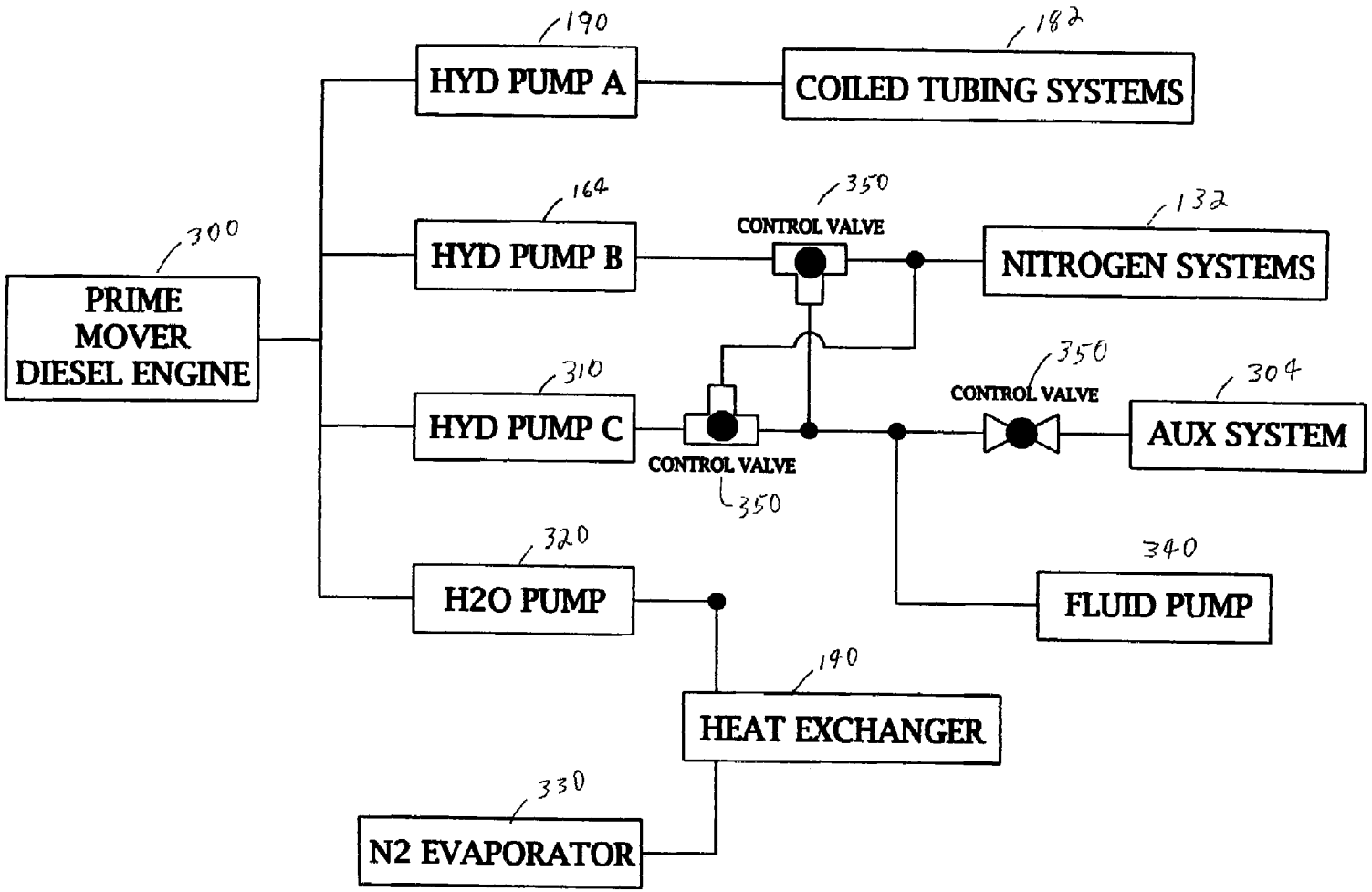
FIG. 12 illustrates, in block diagram, the various systems which are used in accordance with a preferably modularized embodiment of the present invention to treat a well with nitrogen.

The function of the unit, whether like FIG. 8 or modularized as illustrated in FIGS. 9–11. is as follows: the prime mover, preferably a diesel or gasoline engine burns fuel to produce mechanical energy. This energy is used to drive pumps which create fluid/hydraulic energy. This fluid power is directed through a series of control valves (such as illustrated in FIG. 12) to various hydraulic motors. The control for all functions except the fluid pump are located in the operator's console. The fluid pump control is preferably performed at the pump on a dedicated control panel. This separate or independent control is due to the industry accepted practice of having a dedicated pump operator watching fluids being injected into the well and monitoring returns coming back from the well. However, it should be appreciated, by those in the art, that the fluid pump control can be integrated into the operator's console if so desired. The hydraulic motors perform the mechanical work to achieve the required tasks (including, but not limited to, injecting or extracting coiled tubing from the wellbore, turning the coiled tubing reel, boosting liquid nitrogen pressure prior to evaporation into a gaseous state, pumping non nitrogen fluids into the wellbore, and pumping other fluids into the wellbore.) While all of this hydraulic energy is being used to do mechanical work, waste heat or thermal energy is directed for use at the evaporator to provide the necessary energy for the change of state in the nitrogen from liquid to gas.

The major components of a modular system illustrated in FIGS. 9–11 include, but are not limited to, a telescoping operator's console, hose storage racks, remote function hose reels, high pressure nitrogen injection pump, low pressure nitrogen charge pump, nitrogen evaporator, nitrogen system hydraulic distribution manifold, coiled tubing hydraulic distribution manifold, heat exchangers, high pressure fluid pump, fluid charge pump, hydraulic reservoir, function specific hydraulic pumps, and a single diesel engine prime mover.

FIG. 9 illustrates a separate power unit skid designated generally as 400. The power unit skid preferably comprises a single prime mover engine 300 which is preferably a diesel or gasoline engine. However, it should be appreciated that as more efficient fuel sources are developed, the primer mover engine 300 can be powered by any available fuel source that is preferably economical and can cause the engine to deliver the required power. The skid 400 further preferably comprises at least one hydraulic reservoir 380, at least one high pressure fluid pump 370, at least one fluid charge pump 360, at least one radiator 401, at least one hydraulic fluid accumulator, at least one compressed air tank 403, and function specific hydraulic pumps 350 to power the various systems illustrated in FIG. 12. It should be appreciated that the systems shown in FIG. 12 are illustrative only and not intended to be limited to the named systems. It should be appreciated that the present invention envisions the use of a single prime mover engine to power the named systems instead of a separate engine for each system. This premise is based on a need, in the art, to limit space consumption as well as reduce actual pieces of equipment. Therefore, the combination of more than one engine within the same power unit skid, the inclusion of additional engines on the modularized skids, or the inclusion of additional power unit skids should not be construed as being outside the scope of this invention. It should also be appreciated that a separate engine may power the crane, in particular, when the crane is already at the oil or gas well and perhaps being used for other purposes as well.

It should be appreciated, by those in the art that the radiator 401 can preferably function to cool the prime mover engine 300. Further, the radiator can be fluidly connected to the heat exchangers 140 (FIG. 11) in order to provide a cooling fluid for the radiator 401 and a heating fluid for the heat exchangers 140, which are preferably used to heat the liquid nitrogen.

As further illustrated in FIG. 9, the power unit skid 400, preferably contains at least one hydraulic fluid accumulator 402 and at least one compressed air tank 403. The hydraulic fluid accumulator 402 can be used to supplement hydraulic fluid requirements of the various function specific hydraulic pumps 350. The compressed air tank 403 is preferably used to start motors when electric starting is not desirable. It should be appreciated, by those in the art, that certain environments, particularly offshore rigs and the like, discourage or prevent the use of electric starters due to risk of explosion; therefore, air motors can be used to start certain equipment.

FIGS. 10 and 11 illustrate an addition modular skid of this embodiment. This skid preferably comprises a telescoping operators console 34, at least one coiled tubing hydraulic distribution manifold 375, at least one low pressure nitrogen charge pump 365, at least one nitrogen system hydraulic distribution manifold 385, at least one high pressure nitrogen injection pump 133, at least one nitrogen evaporator 330, heat exchangers 140, hose storage racks 305, and hose reels to remote functions 306. It should be appreciated that the remote functions preferably comprise the coiled tubing systems, the nitrogen systems, the fluid pump systems, and any other system necessary to support the well treating operation. It should be appreciated that while these skids are described with specific equipment on each skid, the equipment can be arranged in a variety of ways to incorporate the necessary equipment. It should be appreciated that because the offshore oil and gas installations are space restrictive, some adaptation to individual installations may be required. However, the spirit of this embodiment, that of providing a single power unit to provide energy to operate the coiled tubing system, the nitrogen system, and the fluid system is still met.

FIG. 12 illustrates, in block diagram, the various systems which are used in accordance with this embodiment of the present invention to treat a well with nitrogen. The systems illustrated here can all be powered with a single prime power source 300. These systems, along with the power unit 300 can either be modularized, preferably for off shore operations, or can be incorporated into a single trailer, skid, barge, or the like.

It may be seen from the preceding description that a novel combined power system for oil and gas well treatment has been provided. Although specific examples may have been described and disclosed, the invention of the instant application is considered to comprise and is intended to comprise any equivalent structure and may be constructed in many different ways to function and operate in the general manner as explained hereinbefore. Accordingly, it is noted that the embodiments described herein in detail for exemplary purposes are of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

The invention claimed is:

1. A combined system for treating an oil and/or gas well, comprising:

a single trailer having mounted thereon:

a single engine for providing prime power for the operation of pumps and motors mounted on said single trailer;

a reel of coiled tubing for introducing well treatment fluids into a well;

a coiled tubing injection unit, wherein said coiled tubing injection unit can advance said coiled tubing into a wellbore;

a fluid pumping system for pumping fluids into a wellbore; and a tank of liquid nitrogen, said coiled tubing injection unit, said fluid pumping system, and said tank of liquid nitrogen each being responsive to the operation of said engine.

2. The system according to claim 1 further comprising a crane for picking up and lowering said coiled tubing injection unit.

3. The system according to claim 2 wherein said crane being responsive to the operation of said single engine.

4. The system according to claim 1, including in addition thereto, a first hydraulic pump which can be driven by said engine for manipulating said coiled tubing injection unit.

5. The system according to claim 4, including in addition thereto, a second hydraulic pump driven by said engine and a crane for picking up and lowering said coiled tubing injection unit, said second hydraulic pump being for manipulating said crane.

6. The system according to claim 5, including in addition thereto, a third hydraulic pump driven by said engine for manipulating the output of said tank of liquid nitrogen.

7. The system according to claim 6, including in addition thereto, a fourth hydraulic pump driven by said engine for manipulating said fluid pumping system.

8. A combined system for treating an oil and/or gas well, comprising:

at least one skid having mounted thereon:

a single engine for providing prime power for the operation of pumps and motors mounted on said at least one skid;

a reel of coiled tubing for introducing well treatment fluids into a well;

a coiled tubing injection unit, wherein said coiled tubing injection unit can advance said coiled tubing into a wellbore;

a fluid pumping system for pumping fluids into a wellbore; and a tank of liquid nitrogen, said coiled tubing injection unit, said fluid pumping system, and said tank of liquid nitrogen each being responsive to the operation of said engine.

9. The system according to claim 8 further comprising a crane for picking up and lowering said coiled tubing injection unit.

10. The system according to claim 9 said crane being responsive to the operation of said single engine.

11. The system according to claim 8, including in addition thereto, a first hydraulic pump which can be driven by said engine for manipulating said coiled tubing injection unit.

12. The system according to claim 11, including in addition thereto, a second hydraulic pump which can be driven by said engine and a crane for picking up and lowering said coiled tubing injection unit, said second hydraulic pump being for manipulating said crane.

13. The system according to claim 12, including in addition thereto, a third hydraulic pump which can be driven by said engine for manipulating the output of said tank of liquid nitrogen.

14. The system according to claim 13, including in addition thereto, a fourth hydraulic pump which can be driven by said engine for manipulating said fluid pumping system.

15. A combined system for treating an oil and/or gas well, comprising:

a single trailer having mounted thereon:

single engine for providing prime power for the operation of pumps and motors mounted on said single trailer;

a reel of coiled tubing for introducing well treatment fluids into a well;

a coiled tubing injection unit, wherein said coiled tubing injection unit can advance said coiled tubing into a wellbore;

a fluid pumping system for pumping fluids into a wellbore; and a source of gaseous nitrogen, said coiled tubing injection unit, said fluid pumping system, and said source of gaseous nitrogen each being responsive to the operation of said engine.

16. The system according to claim 15 further comprising a crane for picking up and lowering said coiled tubing injection unit.

17. The system according to claim 16, said crane being responsive to the operation of said single engine.

18. The system according to claim 15, wherein said source of gaseous nitrogen is a nitrogen generator which has a capability for gathering gaseous nitrogen from the earth's atmosphere.

19. The system according to claim 15, wherein said source of gaseous nitrogen comprises at least one tank of compressed nitrogen gas.

20. The system according to claim 15, wherein said source of gaseous nitrogen comprises a plurality of tanks of compressed nitrogen gas.

21. A combined modular system for treating an oil and/or gas well, comprising:

a power unit skid; and an operations skid, wherein said power unit skid further comprises a single prime mover engine, a plurality of hydraulic pumps, a hydraulic reservoir for said plurality of hydraulic pumps, at least one high pressure fluid pump, and at least one fluid charge pump, and wherein said operations skid further comprises at least one telescoping operator's console, at least one coiled tubing hydraulic distribution manifold, at least one low pressure nitrogen charge pump, at least one nitrogen system hydraulic distribution manifold, at least one high pressure nitrogen injection pump, at least one nitrogen evaporator, and at least one heat exchanger.

22. The system according to claim 21, wherein said power unit skid and said operations skid are combined on a single skid.

23. The system according to claim 21 further comprising a crane for picking up and lowering said coiled tubing injection unit.

24. The system according to claim 23 said crane being responsive to the operation of said single engine.

25. A combined system for treating an oil and/or gas well, comprising:

a barge having mounted thereon:

a single engine for providing prime power for the operation of pumps and motors mounted on said barge;

a reel of coiled tubing for introducing well treatment fluids into a well;

a coiled tubing injection unit, wherein said coiled tubing injection unit can advance said coiled tubing into a wellbore;

a fluid pumping system for pumping fluids into a wellbore; and a tank of liquid nitrogen, said coiled tubing injection unit, said fluid pumping system, and said tank of liquid nitrogen each being responsive to the operation of said engine.

26. The system according to claim 25 further comprising a crane for picking up and lowering said coiled tubing injection unit.

27. The system according to claim 26 said crane being responsive to the operation of said single engine.

28. A method for operating a combined system for treating an oil and/or gas well using a single prime moving engine, comprising:

providing a single engine;

providing a reel of coiled tubing;

providing a coiled tubing injection unit;

providing a crane for picking up and lowering said coiled tubing injection unit;

providing a fluid pumping system;

providing a tank of liquid nitrogen;

providing a nitrogen system, said tank of liquid nitrogen being fluidly connected to said nitrogen system, wherein said nitrogen system comprises at least one low pressure nitrogen charge pump, at least one nitrogen system hydraulic distribution manifold, at least one high pressure nitrogen injection pump, at least one nitrogen evaporator, and at least one heat exchanger; and powering said coiled tubing injection unit, said fluid pumping system, and said nitrogen system using said single engine.

29. The method according to claim 28 further comprising powering said crane for picking up and lowering said coiled tubing injection unit using said single engine.

* * * * *